US005252094A

United States Patent [19]

Colleran et al.

[11] Patent Number: 5,252,094

[45] Date of Patent: Oct. 12, 1993

[54] ELECTRICAL CONNECTOR WITH IMPROVED TERMINAL RETENTION

[75] Inventors: Stephen A. Colleran, Lisle; Lawrence E. Geib, Bartlett, both of Ill.

[73] Assignee: Molex Incorporated, Lisle, Ill.

[21] Appl. No.: 983,001

[22] Filed: Nov. 30, 1992

[51] Int. Cl.[5] ..... H01R 13/00

[52] U.S. Cl. ..... 439/733; 439/877

[58] Field of Search ..... 439/421, 422, 733, 877–882

[56] References Cited

U.S. PATENT DOCUMENTS

| | | | |
|---|---|---|---|
| 4,191,442 | 3/1980 | Caveney et al. | 339/99 R |
| 4,227,124 | 7/1991 | Loose et al. | 439/421 |
| 4,264,118 | 4/1981 | Nijman | 339/99 R |
| 4,884,984 | 12/1989 | Matsumoto | 439/877 |
| 4,921,440 | 5/1990 | Matsumoto | 439/421 |
| 4,969,260 | 11/1990 | Kondo et al. | 29/863 |

FOREIGN PATENT DOCUMENTS 2141294 12/1984 United Kingdom .

*Primary Examiner*—Joseph H. McGlynn
*Attorney, Agent, or Firm*—A. A. Tirva

[57] ABSTRACT

A terminal retention system is provided in an electrical connector for terminating a conductor. The connector includes a dielectric housing having a terminal-receiving passage. A terminal is received in the passage. The passage includes an opening for access therethrough of a crimping tool, and the terminal includes a crimp section aligned with the opening for engagement by the crimping tool to deform the crimp section into crimping engagement with the conductor. A cavity is provided in the passage aligned with the crimp section of the terminal and into which the crimp section can deformably expand to retain the crimped terminal in the passage as a function of crimping the crimp section onto the conductor.

10 Claims, 2 Drawing Sheets

ELECTRICAL CONNECTOR WITH IMPROVED TERMINAL RETENTION

FIELD OF THE INVENTION

This invention generally relates to the art of electrical connectors and, particularly, to an improved system for retaining conductor terminals in a connector housing.

BACKGROUND OF THE INVENTION

Most electrical connectors include some form of a dielectric housing for mating with a complementary connector or electrical component, with terminals mounted within the housing for termination to electrical wires or other electrical or electronic conductive components. Usually, the terminals are mounted in passages in the housing, with mating ends of the terminals near a mating end of the housing for interengagement with terminals of the complementary connector. The terminals have terminating ends near a terminating (usually rear) end of the housing for termination to the electrical wires or other conductive components.

One type of electrical connector of the character described above includes a plurality of metal terminals, most often stamped and formed from sheet metal material, which are crimped to a plurality of conductors, such as insulated electrical wires. Each terminal may include a first crimp section for crimping onto and establishing electrical connection with the conductive core of the wire. The terminal often includes a second crimp section for crimping onto the outside insulating cover of the wire to provide a strain relief between the terminal and the wire. Such crimping termination systems sometimes crimp the terminals to the electrical wires in a separate preassembly step, and then the terminal/wire subassemblies are inserted and locked into positions within the housing passages. On the other hand, some such terminal crimping systems mass assemble the terminals into the housing passages; then the wires are inserted into the terminals; and the connector housing is provided with opening means for access therethrough of a crimping tool to crimp the terminals onto the wires "in situ" in the housing.

Problems have been encountered in the latter systems described above wherein the terminals are crimped to the electrical wires while the terminals are mounted within the connector housing. Specifically, practically all such terminals include some form of retaining or latching means to prevent the terminals and/or terminated wires from being withdrawn or pulled out the connector housing. These retaining means normally are separate portions of the terminals, such as outwardly projecting cantilevered latch arms which lockingly engage within or behind latching cavities or shoulders formed within the passages through the connector housing. Since the retaining means are separate from the terminating ends and crimp sections of the terminals, size or envelope problems are encountered, particularly with the ever-increasing miniaturization of electrical connectors and corresponding mating electrical or electronic components. In addition, since the retaining means project substantially outwardly from the terminals, the corresponding latching cavities within the passages of the connector housing also must be of substantial size which, again, causes problems with the ever-increasing miniaturization of such connectors, because the housing walls between the passages must be of substantial thickness which inhibits close center-to-center spacing of the terminals.

This invention is directed to an improved retention system for retaining crimpable terminals in a connector housing by incorporating the retention means directly into the crimp sections of the terminals, the terminal retention being effected as a function of the terminal crimping operation itself. Therefore, the size or length of the terminals can be reduced considerably, and the spacing between the terminals can be reduced because extraneous latch arms or the like have been eliminated.

SUMMARY OF THE INVENTION

An object, therefore, of the invention is to provide a new and improved retention system for retaining crimpable terminals in an electrical connector.

In the exemplary embodiment of the invention, an electrical connector is disclosed for terminating a plurality of conductors such as electrical wires. The connector includes a dielectric housing having a plurality of terminal-receiving passages. A plurality of terminals are inserted into the passages. Each passage includes an opening for access therethrough of a crimping tool, and each terminal includes a crimp section aligned with the opening for engagement by the crimping tool to deform the crimp section into crimping engagement with the conductor. The invention contemplates that cavity means be provided in each passage, aligned with the crimp section of the respective terminal in the passage and into which the crimp section can deformably expand to retain the crimped terminal in the passage as a function of crimping the crimp section onto the conductor.

As disclosed herein, each terminal-receiving passage is in the form of a channel defined by opposite side walls and a bottom wall, with the crimping tool being accessed through the top of the passage. The cavity means into which the crimp section of the terminal is deformable are provided in the side walls of the channel. The crimp section similarly is generally channel-shaped for receiving the conductor or electrical wire and includes side walls and a bottom wall. The side walls are crimped onto the conductor. As the side walls deform during the crimping operation, the side walls expand into the cavity means in the side walls of the channel-shaped passage to provide retention of the terminal and its terminated conductor in the connector housing. In one form of the invention, the side walls of the terminal crimp section includes outwardly projecting dimples for expansion into the cavity means.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE PREFERRED EMBODIMENT

Figure 1:
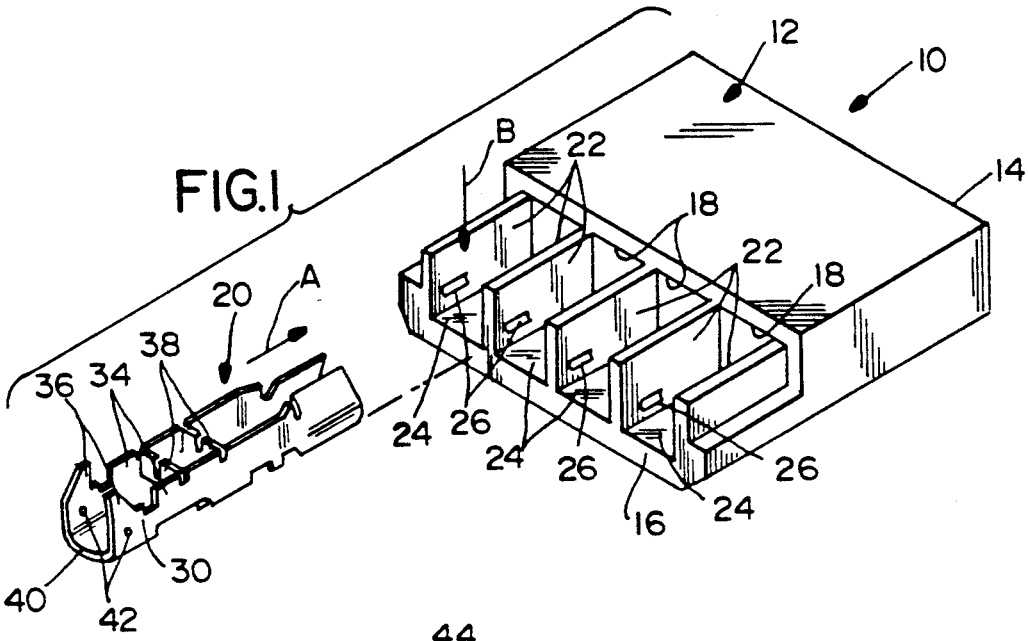
FIG. 1 is an exploded perspective view of an electrical connector housing and one of the terminals mountable in the housing, and incorporating the concepts of the invention.

Referring to the drawings in greater detail, and first to FIG. 1, the terminal retention system of the invention is illustrated in an electrical connector, generally designated 10, for terminating a plurality of conductors, such as insulated electrical wires (described hereinafter). The connector includes a dielectric housing, generally designated 12, which includes a front mating end 14 and a rear terminating end 16, with a plurality of terminal-receiving passages 18 extending through the housing between the ends. The housing may be unitarily molded of plastic material. It should be understood that housing 12 is shown somewhat schematically, in that the housing can take a wide variety of shapes and configurations. Suffice it to say, mating end 14 of the housing is adapted for mating with a complementary electrical connector or other circuit component (not shown).

Generally, each terminal-receiving passage 18 in housing 12 is generally channel-shaped and has open areas near the rear end 16 of the housing for insertion thereinto of a plurality of terminals, generally designated 20, and for access to the terminals in the passages by an appropriate crimping tool as described hereinafter. Specifically, each channel-shaped passage includes a pair of side walls 22 joined by a bottom wall 24. Cavity means in the form of a recess 26 is formed in each side wall 22. Therefore, with this open configuration, terminals 20 are inserted longitudinally into passages 18 in the direction of arrow "A", and an appropriate crimping tool (described hereinafter) is inserted into the passages transversely in the direction of arrow "B". It should be understood that only one terminal 20 is shown in FIG. 1, simply to avoid cluttering the illustration, there being a plurality of such terminals respectively insertable into the plurality of terminal-receiving passages 18.

The use of such terms as "bottom", "top" and the like herein, and in the claims hereof, are not to be construed as limiting. Such terms are used for relative reference purposes only, and the electrical connector and retention system of the invention actually are omnidirectional in use and/or function.

Figure 3:
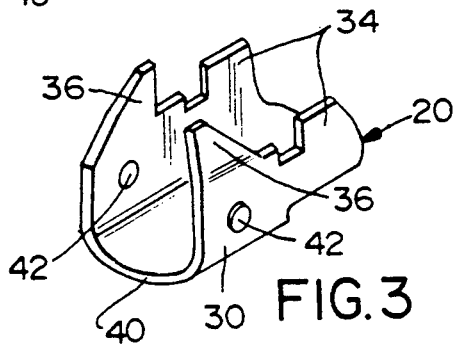
FIG. 3 is a fragmented perspective view of the crimp section of one of the terminals.

Referring to FIG. 3 in conjunction with FIG. 1, each terminal 20 includes a mating end 28, a terminating end 30 and an intermediate conducting section 32. Mating end 28 can be of a variety of configurations, but the configuration shown is a female end for receiving a male terminal of the complementary mating connector. Terminating end 30 is provided as a crimp section which includes a pair of crimp arms 36 for crimping onto the outside insulation of the wire, as described below. Intermediate section 32 includes a pair of slotted transverse walls 38 for interconnection with the conductor of the insulated wire and a pair of support wall 34. In essence, terminal 20, particularly crimp section 30, is generally channel-shaped, with crimp arms 34 and 36 forming part of the side walls of the channel shape, and including a bottom wall 40. Lastly, crimp section 30 includes a pair of dimples 42 projecting outwardly from crimp arms 36.

Figure 2:
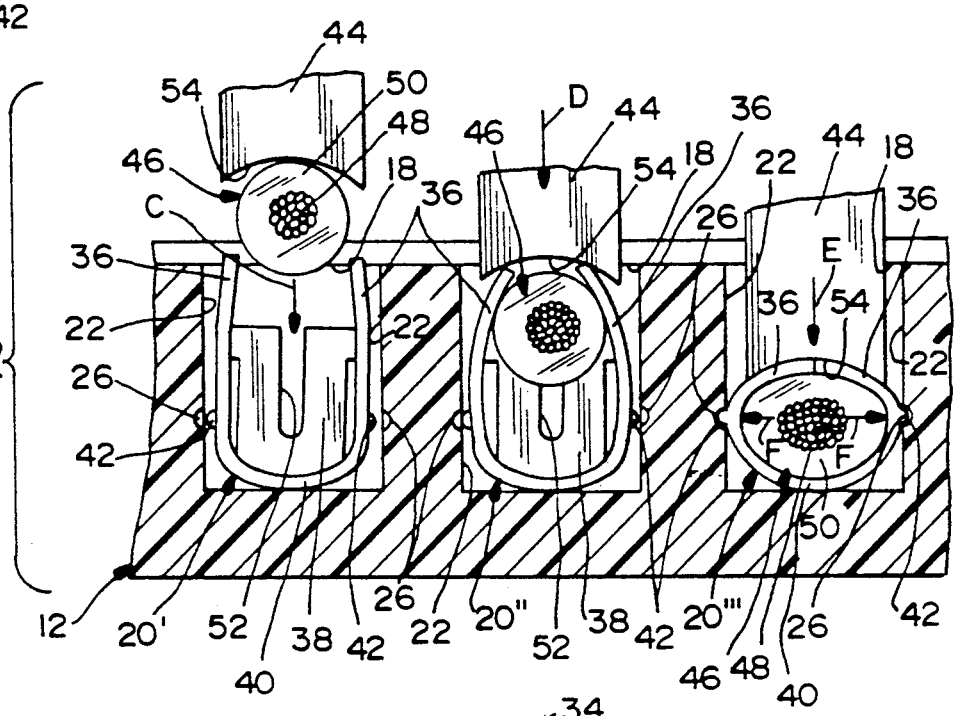
FIG. 2 is a vertical section through three of the terminal-receiving passages in the housing, along with respective terminals in different sequences of being crimped onto respective terminals and retained in the housing.

Referring to FIG. 2, three terminals are shown inserted into their respective terminal-receiving passages 18 in housing 12, with the terminals being sequentially crimped and deformed by an appropriate crimping tool 44. Specifically, in order to facilitate a clear and concise description, the terminals are referenced as 20', 20" and 20"' from left-to-right in the illustration. A conductor, in the form of an insulated electrical wire, generally designated 46, is shown sequentially terminated to the terminals. The electrical wire includes a conductive solid or stranded core 48 surrounded by an insulating cladding or cover 50.

More particularly, referring to the left-hand terminal 20' in FIG. 2, it can be seen that the terminal is positioned within its respective passage 18, with crimp arms 36 (34) in their original or uncrimped condition. As such, the distal end of electrical wire 46 is positioned above the terminal so that the wire can be drive downwardly in the direction of arrow "C" by crimping tool 44. It can be seen that walls 38 of the terminal have slots 52 open at the tops of the walls. It also can be seen that the side walls or crimp arms 36 are spaced from side walls 22 of the respective terminal-receiving cavity 18.

Now, referring to the center terminal 20" in FIG. 2, it can be seen that crimping tool 44 has been moved downwardly in the direction of arrow "D". During this movement, the crimping tool drives electrical wire 46 downwardly therewith, and a concave crimping surface 54 of the crimping tool has initially engaged the top edges of crimp arms 36, beginning to deform the crimp arms inwardly about the top of the electrical wire. Again, it can be seen that crimp arms 36 still are slightly spaced from side walls 22 of the respective terminal-receiving passage.

Lastly, the right-hand terminal 20"' shown in FIG. 2, is illustrated as fully crimped about electrical wire 46. In particular, as crimping tool 44 is moved downwardly in the direction of arrow "E", several functions take place. First, concave surface 54 of the crimping tool continues to engage crimp arms 36 to deform the crimp arms inwardly, as shown, to clamp onto electrical wire 46 to provide a strain relief between the terminal and the wire. If insulating covering 50 has been stripped from a distal end of conductive core 40, the core simultaneously is driven into slots 52 of walls 38. If the insulating covering is not stripped, the slotted walls will cut through the insulation and establish conductive interconnection with the core. In addition, and in accordance with the invention, as crimp arms 36 are crimped and deformed by crimping tool 44, the crimp arms deform outwardly in the direction of arrows "F", whereby the crimp arms expand laterally and move dimples 42 into cavities 26 in the side walls 22 of the respective terminal-receiving passage. Therefore, the terminals are locked or retained within their respective passages against both longitudinal or transverse movement as a function of the crimping operation itself. In essence, the retaining means of the system are incorporated into the crimping sections of the terminals, rather than being independent thereof, whereby the retaining function is effected simultaneously with the crimping operation. Lastly, although not visible in FIG. 2, crimping tool 44 is effective to deform crimp arms 34 (FIG. 1) inwardly the same as described above in relation to crimp arms 36 in FIG. 2.

Figure 4:
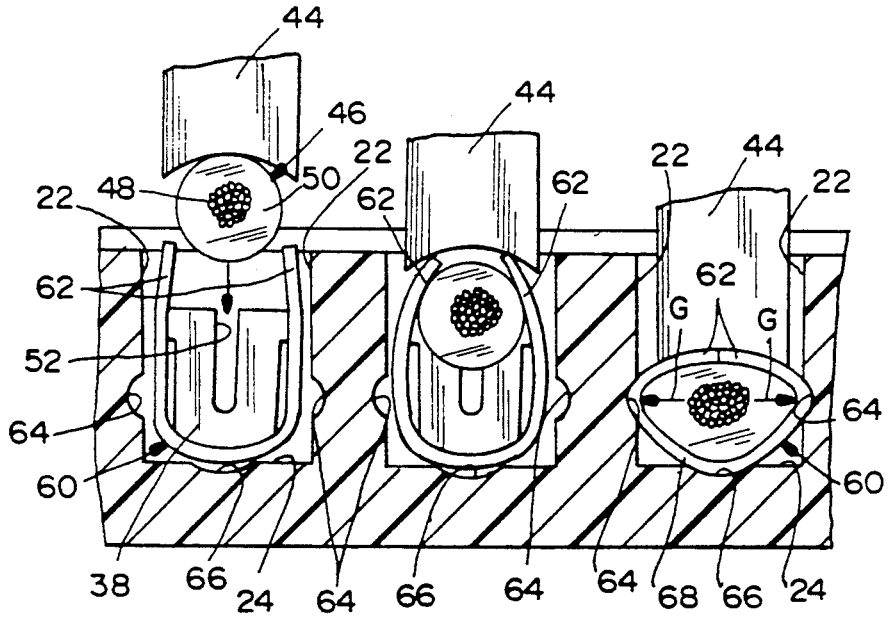
FIG. 4 is a view similar to that of FIG. 2, but of an alternate form of the invention.

Referring to FIG. 4, a modified form of the invention is illustrated, wherein dimples 42 (FIGS. 1 and 3) of the terminals have been eliminated. In the embodiment of FIG. 4, a terminal, generally designated 60, includes a pair of generally straight crimp arms 62, devoid of the dimples, for crimping onto electrical wire 46 by crimping tool 44, as described above in relation to FIG. 2. However, it should be noted that side walls 22 of the terminal-receiving passage is provided with a pair of recessed areas or cavities 64 which are somewhat larger than cavities 26 described above in relation to the embodiment of FIGS. 1-3. In addition, bottom walls 24 of the terminal-receiving passages also are provided with recesses 66. Therefore, as each terminal 60 in FIG. 4 is crimped onto respective electrical wires 46, similar to the operation described above in relation to FIG. 2, crimp arms 62 deform outwardly in the direction of arrows "G" and expand into recessed areas 64. In addition, a bottom wall 68 of the crimp section of the terminal is driven downwardly by the force of crimping tool 44 and deforms into recess 66 in bottom wall 24 of the terminal-receiving passage. Therefore, the deformed portions of the terminal which expand into recesses 64 and 66 are effective to provide a retaining means between the terminals and the connector housing as a function of the crimping operation itself, similar to the operation described above in relation to FIG. 2.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

We claim:

1. In an electrical connector for terminating a conductor, the connector including a dielectric housing having a terminal-receiving passage, a terminal received in the passage, the passage including opening means for access therethrough of a crimping tool, and the terminal including a crimp section aligned with the opening means for engagement by the crimping tool to deform the crimp section into crimping engagement with the conductor, wherein the improvement comprises cavity means in said passage aligned with the crimp section of the terminal and into which the crimp section can deformably expand to retain the crimped terminal in the passage as a function of crimping the crimp section onto the conductor.

2. In an electrical connector as set forth in claim 1, wherein said passage is in the form of a channel defined by side wall means and bottom wall means, with said opening means being opposite the bottom wall means, and said cavity means are located in the side wall means.

3. In an electrical connector as set forth in claim 1, wherein the crimp section of the terminal includes outwardly projecting dimple means for expansion into the cavity means.

4. In an electrical connector as set forth in claim 1, wherein said passage is in the form of a channel defined by side wall means and bottom wall means, with said opening means being opposite the bottom wall means, and said cavity means is located in the bottom wall means.

5. In an electrical connector as set forth in claim 4, wherein said cavity means also are located in the side walls means.

6. A terminal retention system in an electrical connector for terminating an electrical wire, comprising:

a dielectric housing including a mating end and a terminating end with a terminal-receiving passage extending therebetween, the passage having a channel-shaped portion at the terminating end of the housing defined by a pair of opposite side walls, a bottom wall and an open top whereby a crimping tool can be inserted through the open top into the channel-shaped passage, and at least one of the side walls and bottom wall including recess means; and a terminal received in the passage and including a crimp section aligned with said channel-shaped portion of the passage, the crimp section including a pair of opposite side walls and a bottom wall, the side walls being located for engagement by the crimp tool to deform the side walls inwardly into crimping engagement with the electrical wire, and the crimp section of the terminal being deformable in response to engagement by the crimping tool whereby the crimp section expands into said recess means to retain the crimped terminal in the passage as a function of crimping the crimp section onto the electrical wire.

7. The retention system of claim 6 wherein said recess means are located in the side walls of the channel-shaped portion of the passage whereby the side walls of the crimp section of the terminal expand outwardly into the recess means.

8. The retention system of claim 6 wherein said recess means are located in the side walls of the channel-shaped portion of the passage, and the side walls of the crimp section of the terminal include outwardly projecting dimples for expansion into the recess means.

9. The retention system of claim 9 wherein said recess means is located in the bottom wall of the channel-shaped portion of the passage, whereby the bottom wall of the crimp section of the terminal expands into the recess means.

10. The retention system of claim 9 wherein said recess means are located in the side walls of the channel-shaped portion of the passage whereby the side walls of the crimp section of the terminal expand outwardly into the recess means.

* * * * *